United States Patent [19]

Berry et al.

[11] 4,036,380

[45] July 19, 1977

[54] APPARATUS FOR OPENING CIGARETTE CARTONS AND PACKS AND REMOVING THE CIGARETTES

[75] Inventors: R. Arlen Berry, Greensboro; Albert W. Thompson, McLeansville, both of N.C.

[73] Assignee: Loews Theatres, Inc., New York, N.Y.

[21] Appl. No.: 696,362

[22] Filed: June 15, 1976

[51] Int. Cl.[2] ..... B65B 21/02

[52] U.S. Cl. ..... 214/305; 302/2 R

[58] Field of Search ..... 214/304, 305, 309, 310; 302/2 R; 221/31

[56] References Cited

U.S. PATENT DOCUMENTS

| | | | |
|---|---|---|---|
| 1,487,130 | 3/1924 | Witherell | 214/305 |
| 1,858,198 | 5/1932 | Georg et al. | 221/31 |
| 2,818,985 | 1/1958 | Irmscher | 214/305 |
| 3,386,320 | 6/1968 | Pinkham et al. | 214/305 |
| 3,386,602 | 6/1968 | Kanarek | 214/305 |
| 3,926,322 | 12/1975 | Scott | 221/31 |

*Primary Examiner*—Lawrence J. Oresky
*Attorney, Agent, or Firm*—Brumbaugh, Graves, Donohue & Raymond

[57] ABSTRACT

Cigarettes are removed from cartons, as a step in recovering the tobacco, by a machine which removes both side walls of the cartons and both ends of all of the packs in the cartons and directs jets of air generally axially towards the ends of the cigarettes to blow them out of the packs. Relatively thin, high pressure jets remove the center row of cigarettes, and relatively divergent, lower pressure air jets blow the remaining cigarettes out of the packs. A pneumatic separator separates the cigarettes from any particles or pieces of packaging materials blown from the packaging by the air jets.

10 Claims, 5 Drawing Figures

APPARATUS FOR OPENING CIGARETTE CARTONS AND PACKS AND REMOVING THE CIGARETTES

BACKGROUND OF THE INVENTION

As in any industry, there are occasions in the cigarette manufacturing industry when the finished product, cartons of cigarettes, are returned to the manufacturer or are not satisfactory for shipment by the manufacturer. For example, finished, packaged cigarettes may be returned as out of date due to failure to rotate stock, due to removal from the market, for example, in product trials, or due to damage. Generally, the tobacco in the cigarettes is of good quality and because of the high cost of tobacco, it is economically advantageous to recover the tobacco for the manufacture of new cigarettes.

The reclaiming of tobacco from the cigarettes requires, of course, first opening the cartons and packs and removing the cigarettes from those packaging materials. Removing the cigarettes from the packaging has heretofore been a manual operation requiring a large amount of labor carrying on a time-consuming task, and the manual operations resulted in the inclusion of paper and foil fragments mixed in with the cigarettes. It is evident that such a manual process was expensive and not very satisfactory in terms of the end result.

SUMMARY OF THE INVENTION

There is provided, in accordance with the present invention, a machine for removing cigarettes from the packaging that eliminates most of the manual operations required in the past and operates efficiently and effectively to provide cigarettes almost completely free from any of the packaging materials. The machine comprises a conveyor, or an equivalent mechanism, for moving the filled cigarette cartons past a series of working stations with the longest axis of the carton aligned with the direction of movement on the conveyor. At a first working station, devices, such as rotary cutters, remove both side walls of the cartons and both ends of all of the packs in the cartons, thereby leaving both ends of the cigarettes in the packs exposed. At a second station, jets of air are directed at the ends of the center rows of cigarettes, the jets being confined in thin streams to the region traversed by the center row of cigarettes and being oriented substantially parallel to the axes of the cigarettes. The thin or confined, high pressure jets blow the center row of cigarettes out of the packs seriatim as what remains of the original cartons are moved along the conveyor. One or more additional jets of air, such jets being divergent and of lower pressure than the aforementioned jets, blow the remaining cigarettes out of the packs. The cigarettes are picked up by a pneumatic separator which separates the cigarettes from any pieces of the packaging materials that are blown from the cartons with the cigarettes.

A machine, according to the invention, may, and preferably does, include a number of other features, such as:

A hopper to receive a stack of cartons to be opened and deliver the cartons to the conveyor seriatim.

Rotary cutting blades that intersect the cartons at an acute external angle to prevent binding between the blade and the cigarettes and packaging as they move past the blade.

A rotary grinding wheel in association with each blade that can be moved into engagement with the blade to sharpen it.

A pressure plate that resiliently engages the top wall of the carton as it moves along the conveyor to keep the packaging from being removed by the air jets with the cigarettes, the pressure plate being positioned to increase progressively the pressure on the carton, the further along the conveyor moves it, such that the remainder of the cartons and packs are progressively deformed.

The mounting of the cutters and jet nozzles and guides associated with the conveyor to permit adjustment for use with different sized cigarettes.

DESCRIPTION OF AN EXEMPLARY EMBODIMENT

Figure 1:
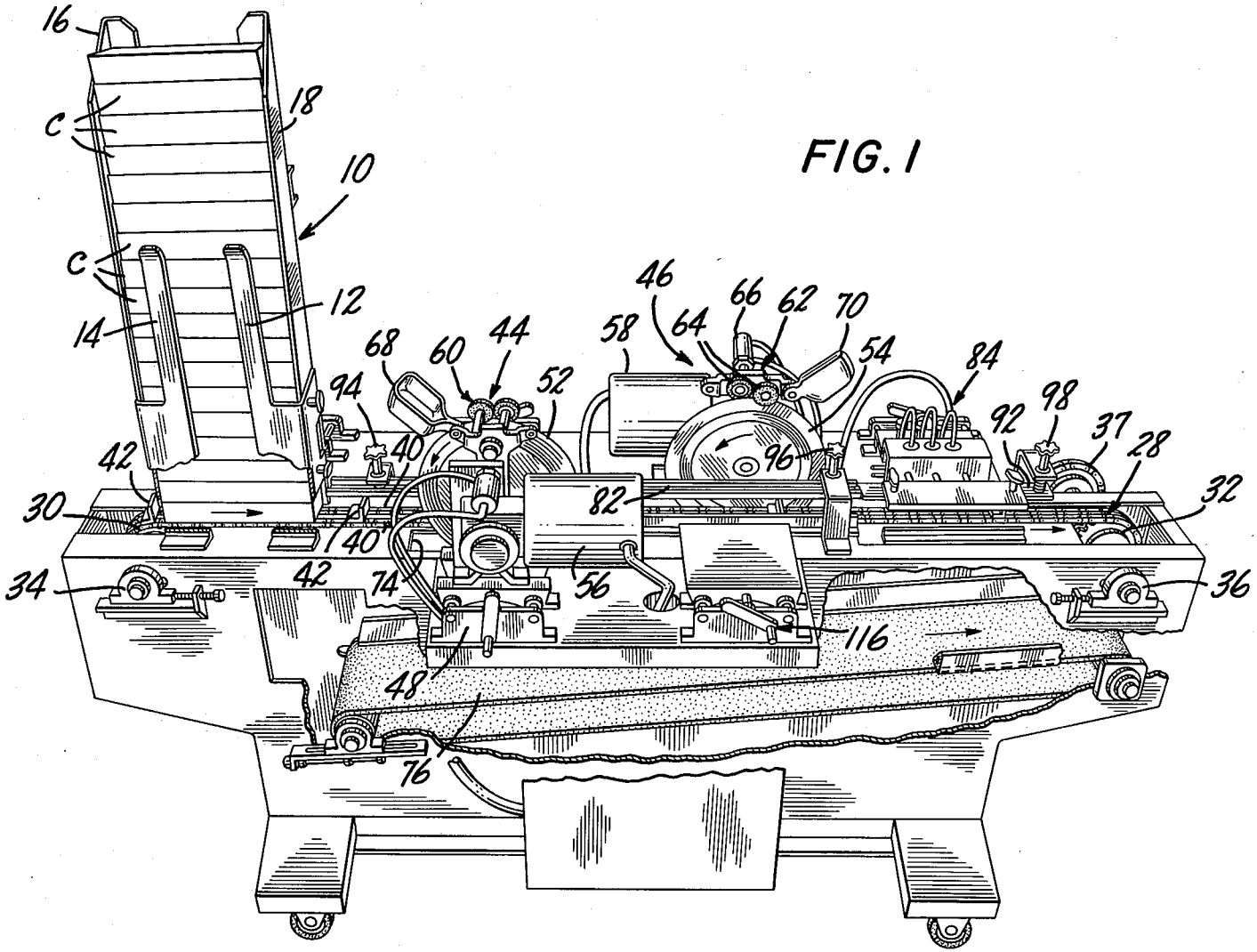
FIG. 1 is a pictorial view of the front of a machine embodying the invention, portions being broken away and some of the details of construction being omitted for clarity.
Figure 2:
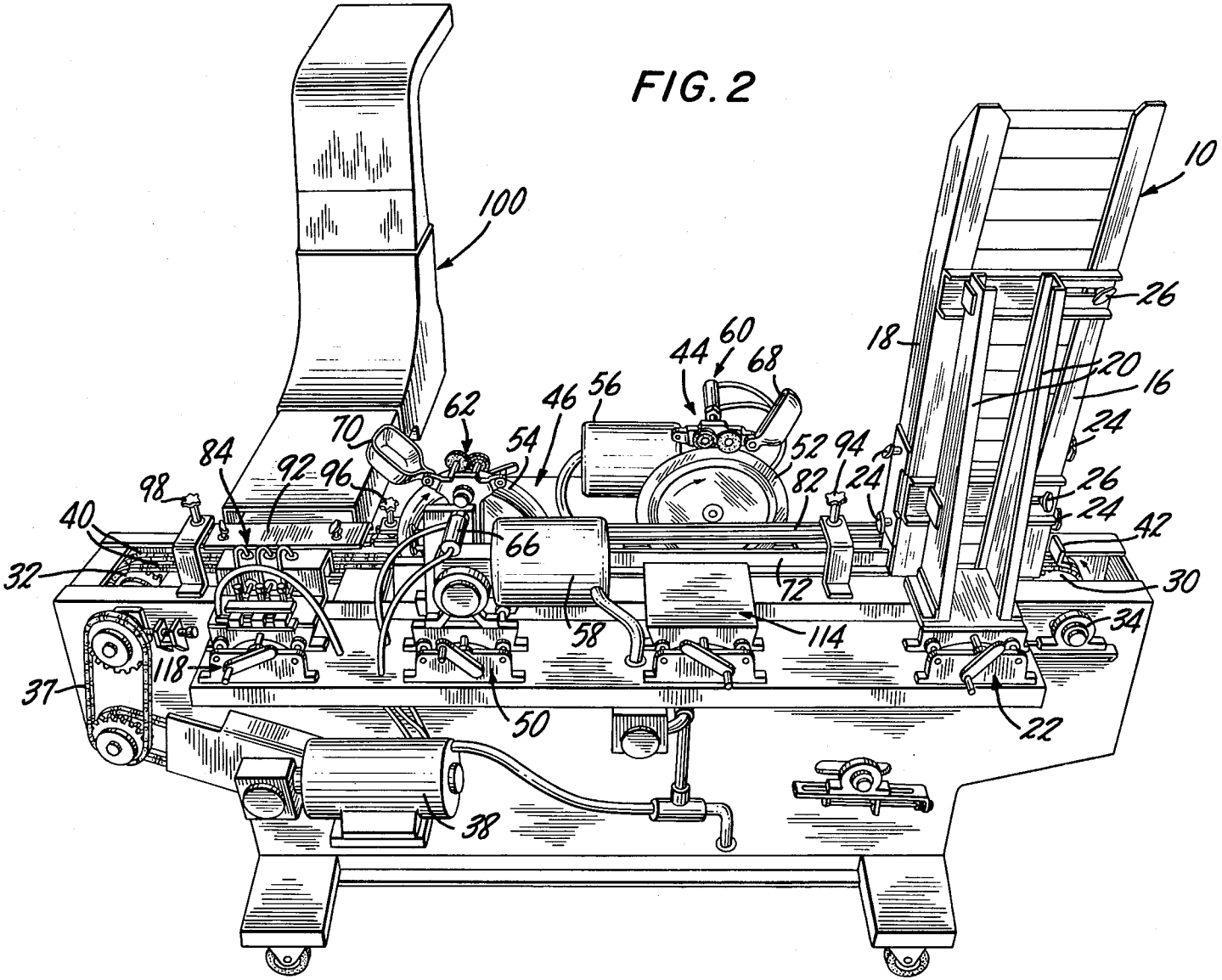
FIG. 2 is a pictorial view of the back of the machine.

Referring to FIGS. 1 and 2, the cartons from which the cigarettes are to be removed for recovery of the tobacco are received in a hopper 10 composed of a pair of front members 12 and 14 and a pair of back members 16 and 18 mounted on supports 20 carried on an adjustable slider bar mounting 22. The front members 12 and 14 are adjustable with respect to the back members 16 and 18 to accommodate cigarettes of different lengths, the front members being moved to the desired position with respect to the back members and then clamped in place by wing nuts 24. Cartons of various lengths are accommodated by adjusting the position of the members 14 and 16 relative to the members 12 and 18 and clamping them in position by wing nuts 26. The hopper 10 is hand loaded and provides gravity feed of the cartons onto a chain conveyor 28. The lower portion of the hopper is substantially vertical, but the upper portion is inclined slightly to the vertical to facilitate hand loading.

A chain conveyor 28 comprises a feed end sprocket 30 and an exit end sprocket 32, each of which is journaled in bearings 34 and 36, respectively, that are adjustable to set the desired tensions in the chains. The sprocket 32 at the exit end of the conveyor is driven by a chain drive 37 powered by a motor 38 to move a pair of laterally spaced-apart chains 40 such that the upper run of the conveyor moves from the feed end where the hopper is located to the exit end, as indicated by the arrows in FIG. 1. The chains 40 carry longitudinally spaced-apart flights 42, the distance between the flights being greater than the maximum length carton to be handled in the machine. In the position illustrated in FIG. 1, a flight 42 at the infeed end of the conveyor is about to engage a carton that has dropped onto the conveyor, and when it has engaged the carton, it will push the carton out of the hopper and move it through the working stations of the machine. Until the lowermost carton in the stack in the hopper has cleared the exit end of the hopper, the cartons above the one being fed are kept from falling by the carton then being pushed from the hopper and by the flight then pushing that carton. After a carton clears the hopper, the stack of cartons will drop down to position the next carton for pickup by the next flight.

The cartons are positioned in the hopper and on the conveyor such that the cigarettes are aligned horizontally and transversely with respect to the movement of the conveyor, and the pack ends within the carton lie vertically at either side of the conveyor. The conveyor moves the cartons into engagement, in succession, with cutting mechanisms 44 and 46, one of which is mounted on each side of the conveyor, and both of which are mounted on screw driven adjustable slide bar assemblies 48 and 50. Each cutting mechanism 44 or 46 comprises a cutting blade 52, 54 driven by a motor 56, 58, and a selectively operable sharpener 60, 62. Each sharpener, for example, the one numbered 62, includes small grinding wheels 64 which are automatically pivoted into and out of engagement with the cutting blade periodically during normal operation of the machine by a small air motor or actuator 66. The sharpeners, though an optional accessory of the machine, greatly reduce the shutdown time that would otherwise be required for sharpening the blades. Items 68 and 70 in FIGS. 1 and 2 are guards that are normally closed over the sharpeners. Incidentally, FIGS. 1 and 2 do not illustrate blade guards which are, of course, a desirable safety feature for the machine and can readily by designed and installed as a matter of routine engineering.

Figure 3:
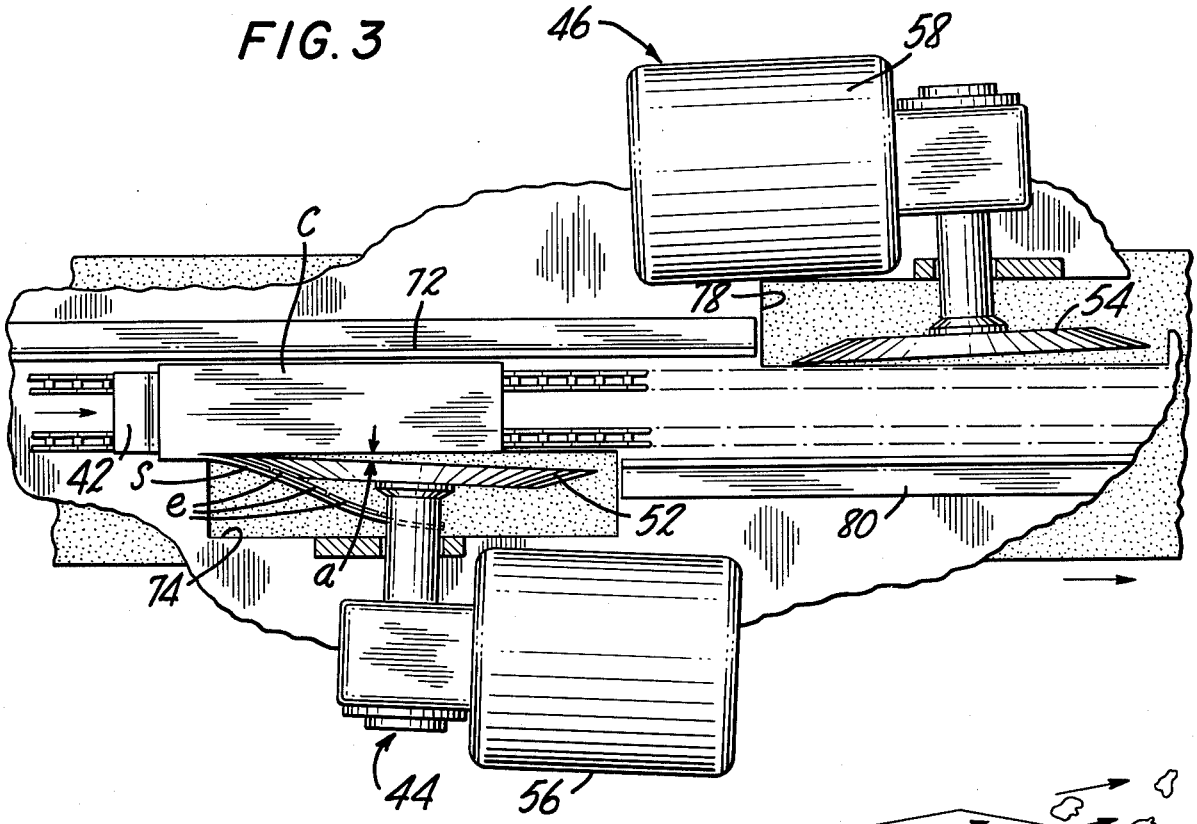
FIG. 3 is a top view of the cutting station of the machine.

Referring to FIG. 3, a carton, which is designated by the letter "*c*," is shown in the process of having one side wall removed by the cutter 44. The cutter 44 is positioned so that the blade 52 forms an acute external angle, designated "*a*" in the Figure, to prevent the binding that would otherwise occur between the blade and the cigarettes and packaging if the blade were to be oriented flat against the plane of movement of the walls of the cartons. The blade 52 is positioned so that it cuts off the side wall "*s*" of the carton and the end walls "*e*" of the packs in the cartons. As the carton "*c*" moves past the first cutter 44, the other side wall (the one not being cut) is backed up by a guide rail 72. The side wall "*s*" and the pack ends "*e*" cut from the carton fall through an opening 74 in the machine housing and down onto a conveyor belt 76 (see FIG. 1) which is driven by the machine drive 38 and 40 (see FIG. 2) to move the upper run toward the exit end of the machine, as indicated by the arrow 1, thus transporting the carton side walls and the pack ends out of the machine for disposal.

Referring again to FIG. 3, after the first cutter 44 finishes removing one side wall and the pack ends on the front side of the machine, the carton moves on to the second cutter 46 which removes the other carton side wall and the other pack ends of the cigarette packing. The cutters 44 and 46 are essentially identical, except that their directions of rotation, as viewed from the blades faces, are opposite; when viewed from the front of the machine, both blades rotate counterclockwise, thereby to tend to push down on the cartons and feed the carton side walls and pack ends down toward the hopper. The machine housing includes an opening 78 through which the side walls and pack ends drop onto the hopper 76, and a backup guide rail 80 is positioned opposite the second cutter 46. A vertically adjustable, spring-loaded top guide rail 82 extends through the cutting station of the machine to hold the cartons down as they move through the cutters.

After the carton side walls and pack ends have been removed at the cutting station, thereby leaving both ends of all of the cigarettes exposed, but leaving the cigarettes intact in the remaining parts of the packs and the packs in place in the remaining part of the carton, they move past a series of nozzles from which jets of air are blown toward the ends of the cigarettes from one side of the conveyor to blow them out of the packs. The nozzles and the ancillary elements which are involved in removing the cigarettes from the pack are designated generally by the reference numeral 84, are referred to herein as the air jet unit, and involve three operations, as described below.

Figure 4:
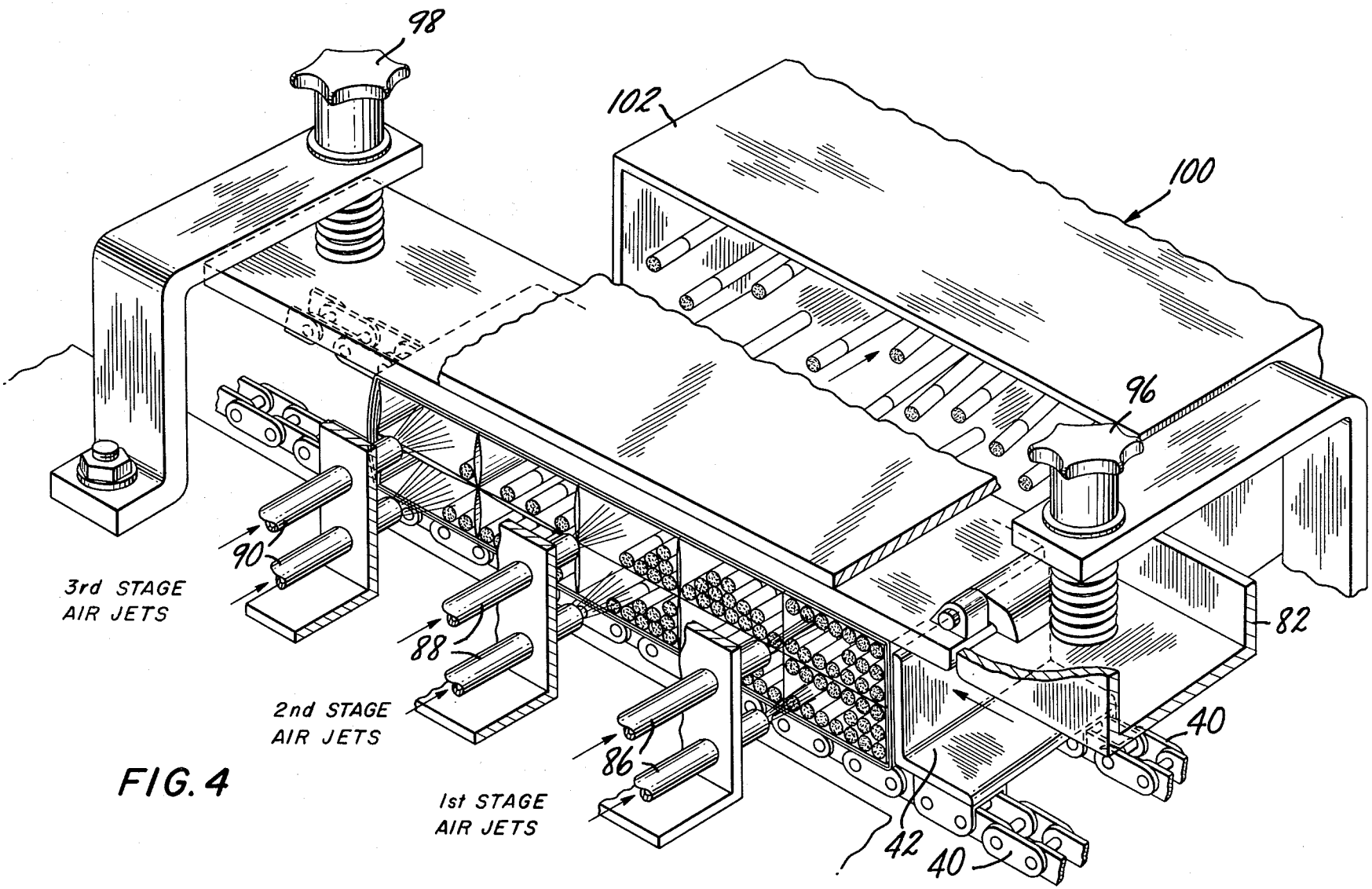
FIG. 4 is a pictorial view of the air jet station.

Referring to FIG. 4, cigarettes are almost universally packaged relatively tightly in an arrangement of front and back rows of seven cigarettes each lying, respectively, against the front and back walls of the pack. And a center row of six cigarettes, each of which nests between pairs of cigarettes of the front and back rows. The first operation of the air jet unit 84 involves directing a thin, relatively high pressure jet toward the middle row of cigarettes in each of the then vertically superposed packs, such jets being indicated by the legend "1st stage jets" in FIG. 4 and the nozzles being designated by the numeral 86. The first stage jets are directed at the zone traversed by the center rows of the cigarettes, and the zone of impingement of each first stage jet is generally coextensive with the end area of a cigarette. As the cartons move past the first stage jets, the cigarettes in the center rows of all of the packs are blown seriatim out of the end of the pack away from the jet. Some of the cigarettes in the front and back rows may also be blown out by the first stage jets, but a substantial manner of the cigarettes in each pack moves on to the next stage. After the middle row cigarettes are blown out, the top row cigarettes fall down onto the bottom row cigarettes.

The second stage jets (nozzle 88) are directed generally toward the lower parts of the superposed packs and are somewhat divergent such that they cover a major portion of the zone traversed by the remaining cigarettes in the packs. The second stage jets remove most of the cigarettes that remain in the packs after the first stage, but there are likely to be a few cigarettes left in each pack after the second stage.

The third stage jets (nozzles 90) are of greater divergence than the second stage and are of lower pressure so that they sweep substantially the entire area of the pack as it moves past. All remaining cigarettes are removed by the third stage air jets.

As the cigarettes move through the air jet unit 84, the then remaining packaging materials (the top and bottom and end walls of the carton and the front, back and side walls of the pack) are engaged between the conveyor chains 40 and an adjustable, resiliently mounted pressure plate 92 which is hinged at its infeed end to the exit end of the top guide 82. The exit end of the pressure plate 92 is adjusted to a position such that the remaining packaging materials are gradually compressed vertically to retain them on the conveyor and prevent them from being blown from the conveyor by the air jets. Thus, when the carton first moves into the air jet unit there is little pressure exerted on it, but the carton and packs are gradually compressed as the carton moves through the unit. The extent of vertical compression of the packaging and the cigarettes therein as they move along the conveyor past the various stations is adjustable by hand-operated adjusting screws 94, 96 and 98 and is exerted by a spring associated with each adjusting screw.

The remainders of the carton and packs are transported by the conveyor 28 from the air jet unit 84 to the exit end of the machine and are pushed off the end of the machine into a suitable receptacle (not shown) positioned at the exit end. The carton side walls and pack ends removed by the cutters 44 and 46 are transported by the conveyor 76 to the exit end of the machine and are discharged into the aforesaid receptacle.

Figure 5:
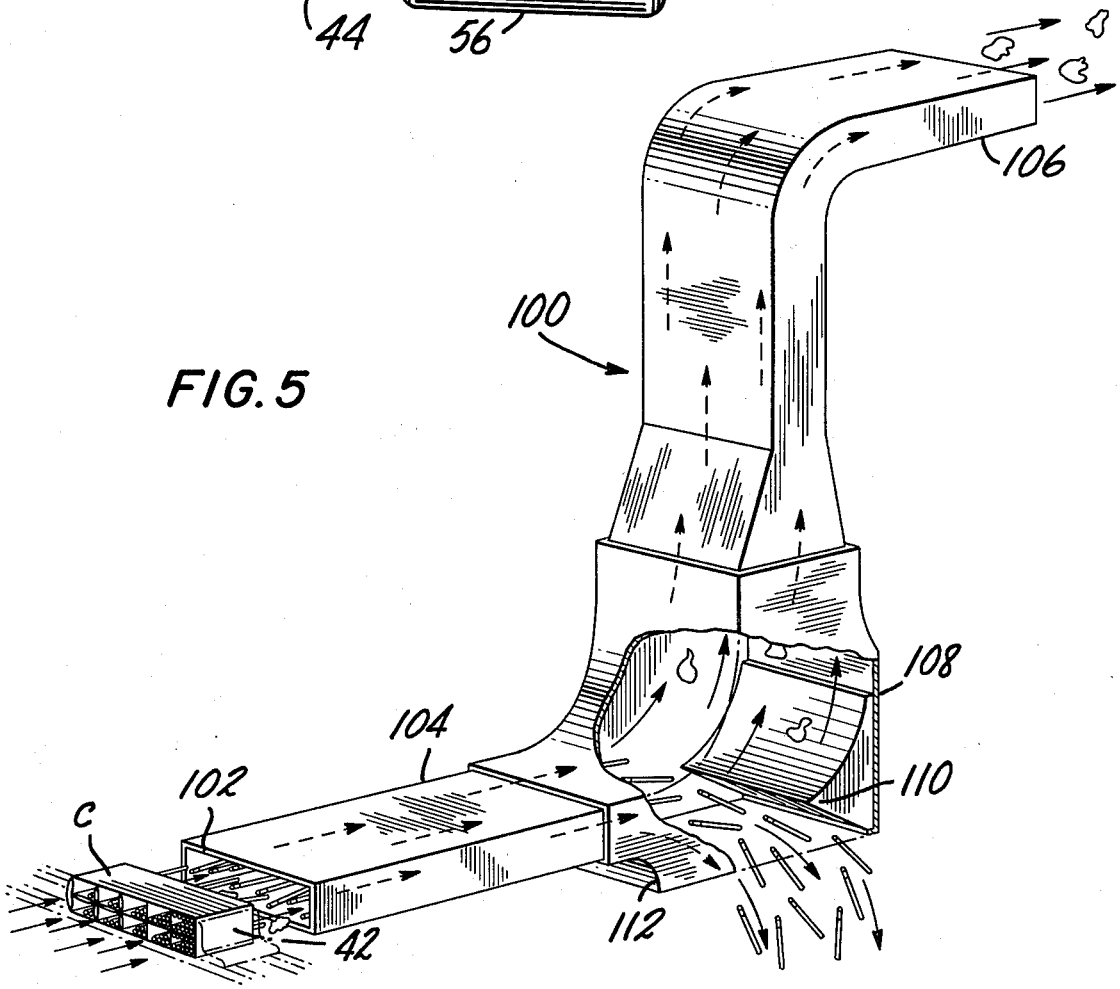
FIG. 5 is a pictorial view of the pneumatic separator.

Meanwhile, the cigarettes blown from the packaging by the air jet unit 84 are picked up by a pneumatic separator 100, the inlet end 102 of which is located opposite from the air jet nozzles (see FIG. 4). The pneumatic separator 100 (see FIG. 5) inlcudes an inlet stage in the form of a generally horizontal duct through which the cigarettes and any wrapping materials are picked up by air drawn through the separator at a point downstream of its waste outlet 106 and a separator section 108 which includes a diverter element 110. Under the influence of the velocity generated by the air jets which remove the cigarettes from the packaging and the air stream drawn through the separator, the cigarettes and any packaging removed with them separate by gravity, the cigarettes being discharged through an outlet 112 at the bottom of the separator section 108 and the lighter packaging pieces being drawn up toward the exit end of the separator 106 and being pneumatically conveyed for further handling. It should be apparent that the mechanism involved is pneumatic classification and takes advantage of the fact that the cigarettes are denser and heavier with respect to the geometric configuration than the packaging materials. The cigarettes are discharged into a waiting receptacle (not shown).

To adapt the machine for cigarettes of a different size, the hopper is adjusted in the manner previously described to receive the new size cartons and is moved by the adjusting device 22 to proper position centered over the conveyor. The cutters are moved by the adjusting mechanisms 48 and 50. The guide rail 72 on the back side of the machine opposite the cutter 44 is mounted for adjustment on a rail-type, screw-operated adjusting mechanism 114, and a similar mounting on an adjusting mechanism 116 is provided for the front guide rail 80 opposite the second cutter 46. The air jet unit 84 is repositioned by operation of its adjustable mounting 118. Although the adjusting features of the machine are optional, they are highly useful in that they provide flexibility in the machine as to use for the several sizes of cigarettes that are now, and will in the future be, marketed.

Thus, there is provided, in accordance with the invention, a machine that automatically opens cigarette cartons and packs, removes the cigarettes from the packs and separates the cigarettes from any extraneous packaging materials leaving the machine with the cigarettes. The machine can be operated by one operator and can handle various sizes of cigarettes and cartons. Throughputs of about one carton per second are readily obtainable. With relatively simple adjustments of the guides, and by shutting off the upper air jet nozzles of the air jet unit, the machine can be set up to handle individual packs of cigarettes by stacking the packs in the hopper. When set up for packs, the operation of the machine is essentially unchanged. It is intended that the processing of individual packs be deemed to be fully equivalent to the processing of cartons.

We claim:

1. Apparatus for opening cigarette cartons and the packs of cigarettes in the cartons and removing the cigarettes from the packs comprising means for conveying the cartons of cigarette packs along a predetermined path with the cigarettes aligned transversely to the axis of the path, means at a first station along the path for removing both side walls of the cartons and both ends of all of the packs in the cartons, means at a second station along the path for directing jets of air in a direction parallel to the axes of the cigarettes and confined substantially to a region traversed by the center row of cigarettes in each pack as the packs move along the path to blow seriatim the cigarettes in the center rows out of the packs, means at a third station along the path for directing divergent jets of air generally parallel to the axes of the cigarettes at regions traversed by the remaining cigarettes not removed from the packs at the second station to blow at least some of the remaining cigarettes out of the packs, and means at the second and third stations for restraining the carton and packs from being blown from the conveying means by the air jets.

2. Apparatus according to claim 1 wherein the means at the first station includes a pair or rotary cutting blades, each of which is positioned to engage and progressively sever one side wall of the carton and the ends of the packs adjacent that wall as the carton moves along the path.

3. Apparatus according to claim 2 wherein each rotary cutting blade intersects the wall of the carton that it removes at an acute external angle to prevent binding between the blade and the cigarettes, packs and cartons as they move past the blade.

4. Apparatus according to claim 2 and further comprising in association with each cutting blade a rotary grinding wheel mounted to be moved selectively into engagement with the cutting blade to sharpen it.

5. Apparatus according to claim 1 in which the pressure of the air jets produced by the jet directing means at the second station is substantially higher than the pressure of the air jets produced by the jet directing means at the third station.

6. Apparatus according to claim 1 and further comprising means at a fourth station along the path for directing additional divergent jets of air generally parallel to the axes of the cigarettes at regions traversed by the open ends of the packs in the cartons to blow out of the packs any cigarettes not removed at the third station.

7. Apparatus according to claim 6 wherein the air jets at the fourth station are of lower pressure and have greater angles of divergence than the air jets at the third station.

8. Apparatus according to claim 6 wherein the restraining means extends to the fourth station.

9. Apparatus according to claim 1 wherein the restraining means includes a pressure plate resiliently urged into engagement with the top wall of the carton to press the carton toward the conveying means, the plate being positioned to increase progressively the pressure on the carton the farther along the path is moves such that it is progressively deformed to bind the packs and the carton more strongly as the cigarettes are removed.

10. Apparatus according to claim 1 and further comprising pneumatic separating means having an inlet positioned at the second and third stations across the conveying means from the air jet directing means to receive the cigarettes blown from the packs and separate the cigarettes from any pieces of the packs and carton that are blown from the packs and carton with the cigarettes.

* * * * *